United States Patent [19]

Robbins et al.

[11] 3,982,664

[45] Sept. 28, 1976

[54] BATCH CONTROLLER FOR GASOLINE HAVING DRIBBLE FEED

[75] Inventors: Elmer A. Robbins; William D. Key, both of Fort Wayne, Ind.

[73] Assignee: Tokheim Corporation, Fort Wayne, Ind.

[22] Filed: Sept. 4, 1975

[21] Appl. No.: 610,103

[52] U.S. Cl. ..... 222/21; 222/26; 222/34; 235/151.34

[51] Int. Cl.[2] ..... G07F 13/02

[58] Field of Search ..... 235/151.34, 92 FL; 194/13; 222/14–16, 20, 21, 26, 34

[56] References Cited

UNITED STATES PATENTS

| | | | |
|---|---|---|---|
| 3,285,381 | 11/1966 | Robbins | 222/20 X |
| 3,550,743 | 12/1970 | Rothschild et al. | 194/13 |
| 3,605,973 | 9/1971 | Burke et al. | 194/13 |
| 3,731,777 | 5/1973 | Burke et al. | 194/13 |
| 3,737,017 | 6/1973 | Brunone | 194/13 |

*Primary Examiner*—Robert B. Reeves
*Assistant Examiner*—David A. Scherbel
*Attorney, Agent, or Firm*—Lundy & Welch

[57] ABSTRACT

A batch controller for automatically and selectively controlling a plurality of material dispensers. The controller includes circuitry for metering, for slowing, and for terminating the flow of material in and at selectable quantity levels thereof. The apparatus includes a starting circuit that renders the apparatus inoperative in response to the absence or interruption of operating potential, and flow of the material is controlled by devices that provide fail-safe termination of flow in the event of failure.

5 Claims, 4 Drawing Figures

BATCH CONTROLLER FOR GASOLINE HAVING DRIBBLE FEED

BACKGROUND OF THE INVENTION

1. Field of the Invention

The present invention relates to devices for controlling the dispensing of batch quantities of materials and in particular to such an apparatus for preparing batches of one or more fluids, the apparatus automatically controlling, slowing and automatically terminating the flow of fluids upon the dispensing of preselected quantities thereof.

2. Description of the Prior Art

Devices for automatically metering predetermined quantities of fluids are well known. Such devices range from the common fuel dispenser found at retail gasoline stations to sophisticated batching systems for measuring and dispensing batch materials in industrial applications. Retail fluid dispensers and similar dispensers are limited in that they can dispense only a single material. Some such dispensers incorporate means for automatically terminating dispensing of the fluid or other material, but such devices have typically been electromechanical and have permitted the metering or dispensing of only incrementally fixed quantities of the material. In other systems, typically those for large industrial applications, devices for automatically controlling the dispensing of materials are highly sophisticated, complex systems. Such systems are expensive and specifically adapted for the particular application.

There exists, therefore, a need for a relatively small, compact and versatile device for controlling the preparation of a fluid batch by dispensing one or more different fluids, the quantity of material to be dispensed being readily altered, control of the dispensing or metering being precise, and wherein the system is highly reliable and fail-safe.

SUMMARY OF THE INVENTION

Broadly, the invention is an electronic batch controller for controlling the dispensing of one or more fluids or other flowable materials. The apparatus permits preselection of the quantity of material to be dispensed and preselection of a point in the dispensing cycle at which dispensing of the material will be slowed to prepare the system for termination of the dispensing cycle. The apparatus can be utilized to control dispensing of one or more materials or to control a plurality of dispensers for a single material.

The apparatus comprises in combination starting circuit means connected to a source of operating potential and including a switch for generating an operating signal in response to operation of said switch, and reset circuit means including a reset switch for generating a reset signal in response to operation of said reset switch. A plurality of flow generating means are provided, said flow generating means being operable between on and off states for generating a flow of material. Pulse generating means are coupled to the output of each of the flow generating means for generating electrical pulse signals in response to each incremental quantity of flow therefrom. Also provided is a presettable counter means for generating a fast-flow control signal and a slow-flow control signal in response to said operating signal, said presettable counter means including a pulse input circuit for receiving said electrical pulse signals from said pulse generating means. Also included in the presettable counter means is means for terminating the fast-flow signal in response to a first selected number of said pulse signals and means for terminating the slow-flow signal in response to a second selected number of said pulse signals.

A plurality of fast-flow control valve means each being operable between open and closed conditions in response to said fast-flow control signal and the absence thereof, respectively, are coupled to the output of said flow generating means for controlling the flow of the material at a first flow rate. A plurality of slow-flow control valve means are operable between open and closed conditions in response to said slow-flow control signal and the absence thereof, respectively, for controlling the flow of the material at a second flow rate, the second flow rate being substantially smaller than the first flow rate. There are one of said fast-flow control valve means and one of said slow-flow control valve means and one of said incremental pulse generating means associated with each said flow generating means. A multiple position switch means is provided for individually coupling associated ones of said flow generating means, fast-flow control valve means, slow-flow control valve means, and electrical pulse generating means to the presettable counter means.

It is therefore an object of the invention to provide an improved batch controller for controlling a plurality of material dispensers.

It is another object of the invention to provide such a controller which permits preselection of the quantity of material to be delivered.

Yet another object of the invention is to provide such a controller which enables selection of a predetermined quantity of material dispensed at which dispensing of the material will be slowed preparatory to termination of the dispensing cycle.

Another object of the invention is to provide such a controller adapted for use in a wide variety of dispensing applications without special equipment or modification.

Yet another object of the invention is to provide such a controller having switch means for selectively coupling one associated group of a fast-flow and a slow-flow control valve, a flow generating means, and pulse generating means of a plurality of such groups to said controller at one time.

Another object of the invention is to provide such a controller which includes a starting circuit operable to automatically disable said controller upon incomplete termination of a dispensing cycle.

Another object of the invention is to provide such a controller having inherent fail-safe characteristics to prevent over dispensing and inacurate dispensing in the event of power failures, and other interruptions of the dispensing cycle.

Still another object of the invention is to provide such a controller which is compact, versatile, relatively inexpensive, and reliable in operation.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings, wherein.

DESCRIPTION OF THE PREFERRED EMBODIMENT

Figure 1:
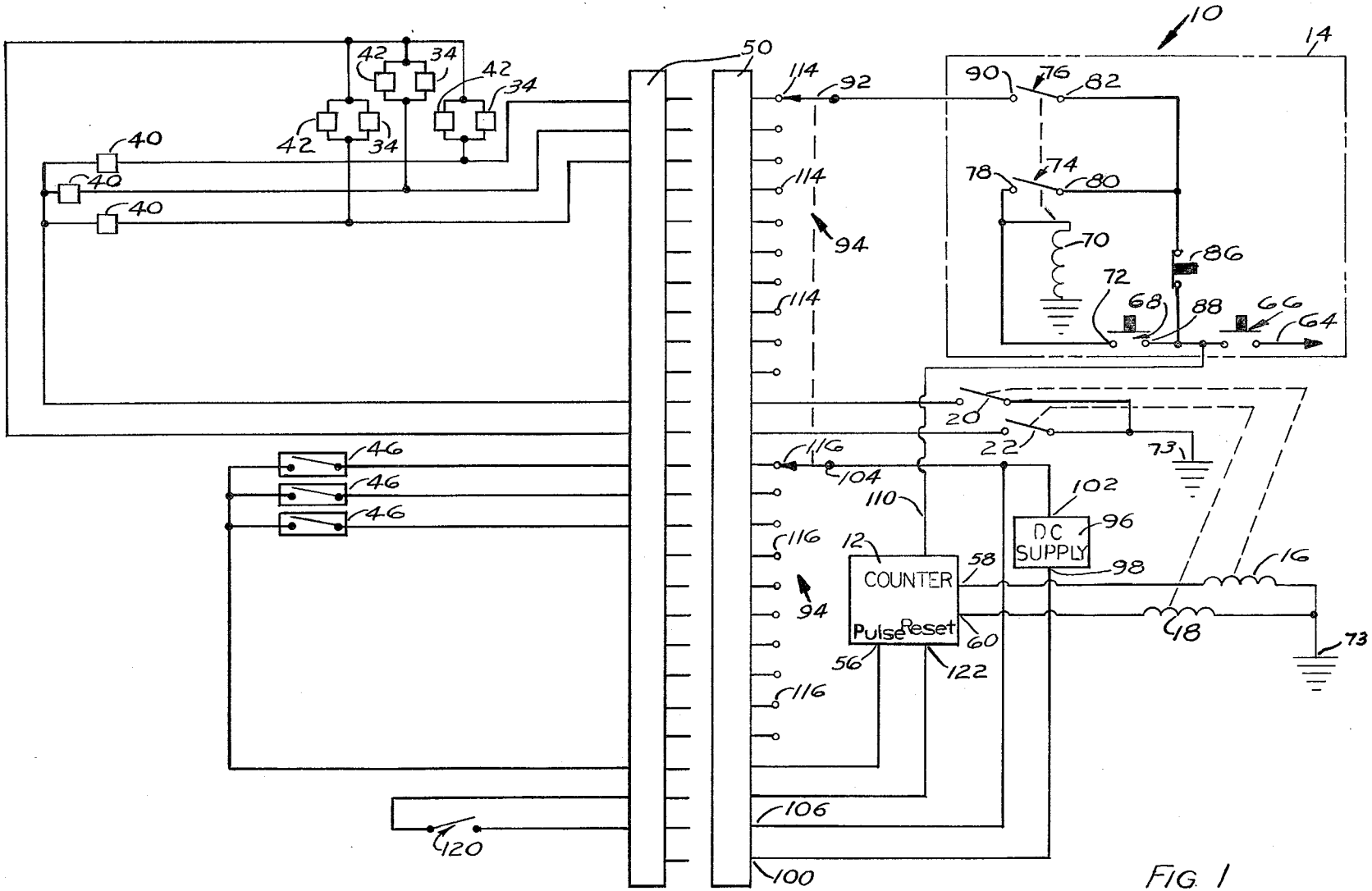
FIG. 1 is an electrical schematic of a controller in accordance with the present invention.

Referring now to the drawings, there shown in FIG. 1 an electrical schematic of an electronic batch controller 10 in accordance with the present invention. The controller includes a presettable counter means 12, a starting circuit in dashed box 14, and control elements 16, 18, in the form of relays having normally open contacts 20, 22, respectively. As can best be seen in FIGS. 2 and 3, a plurality of flow control valves 24, there being ten such valves 24 in the illustrated embodiments, are coupled, in the embodiment of FIG. 2, to the input 26 of a fluid meter 28. Still referring to the embodiment of FIG. 2, meter 28 is connected to the input 30 of a fluid pump 32 which in turn is driven by an electrical motor or the like (not shown) operation of which is effected through a motor controller 34. A plurality of material storage tanks 36, there being one such storage tank 36 for each flow control valve 24 in the embodiment of FIG. 2, have their outlets 38 connected to the fluid pumps 32, through the flow control valve 24 and fluid meters 28 each of the latter having operatively coupled thereto a pulser 46 for generating an electrical pulse signal in response to each incremental quantity of fluid passed through meters 28.

Flow control valves 24 are conventional devices having a plurality of orifices or similar mechanisms for permitting the flow of material therethrough at two different flow rates. Typically one of the flow rates will be relatively high, i.e., the capacity of the flow control valve 24, and the second flow rate will be substantially reduced and is typically referred to as a slow-flow rate. Flow at the two different rates is effected by energization of a fast-flow solenoid 40 and a slow-flow solenoid 42, respectively. Such flow control valves are, again, conventional and well known to those skilled in the art. Similarly, fluid meter 28, pump 32, and motor controller 34, are all conventional devices well known to those skilled in the art.

Figure 3:
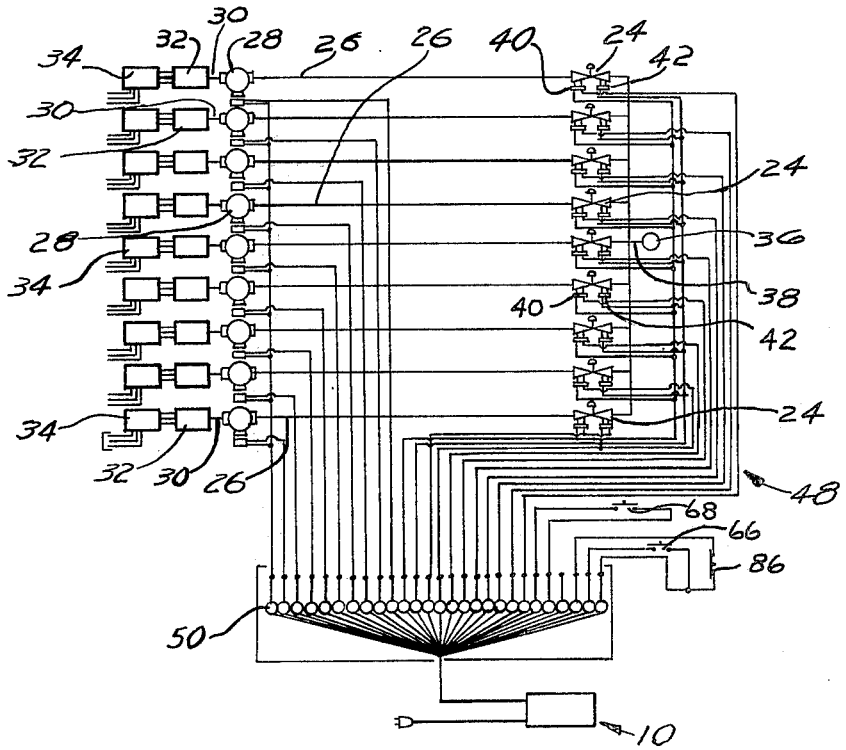
FIG. 3 is a block diagram showing the controller of the present invention adapted to a single tank, multiple product application.

The embodiment of FIG. 3 is similar except that there is but a single supply tank 36 containing a single material and the single fluid meter 28, pump 32, and motor controller 34 are replaced by a plurality of such devices all connected to the supply tank 36.

Motor controller 34, solenoid valves 40, 42, and pulsers 46 associated with meters 28 are all electrically operated devices and are coupled to circuit 10 by a plurality of conductors 48 and a connector 50.

Referring now to FIG. 1, counter 12 is preferrably a solid state, decrementing counter. The counter 12 is provided with an electronic digital read-out 50 (FIG. 4) and preset and presignal thumb wheel switch groups 52, 54, respectively. Such counters are conventional and commercially available such as for example a Model AO612 manufactured by Hecon Corporation of Eatontown, New Jersey. In operation, counter 12 receives input pulses via an input terminal 56, these input pulses being counted or otherwise accumulated internally thereof. Selected numbers, corresponding to material or fluid quantities in the present invention, are entered into the counter by the switches 52, 54. The quantity selected via switches 52 represents the total quantity of material to be dispensed and the reading entered via switches 54 corresponds to a quantity of material remaining to be dispensed when the flow rate thereof is to be slowed in preparation for termination of the dispensing cycle. When the counter 12 is initially conditioned for the beginning of a dispensing cycle, it generates a fast-flow output signal at output terminal 58 and slow-flow output signal at its slow-flow output terminal 60. When the quantity of material remaining to be dispensed equals the quantity entered on switches 54, the fast-flow signal at terminal 58 terminates. When the quantity of material dispensed corresponds to the quantity of material entered on switches 52, the slow-flow output signal appearing at terminal 60 is terminated.

Connected to terminal 58 is relay coil 16 and to terminal 60 is connected relay coil 18.

Starting circuit 14 has an input terminal 64 connected to the high side of a source of alternating current operating potential (not shown). Connected electrically in series with terminal 64 is a two position on-off switch 66. Connected electrically in series with on-off switch 66 is a momentary contact, normally open start switch 68. A latching relay coil 70 is connected between terminal 72 of switch 68 to ground 72. First and second normally open relay contact sets 74, 76 are operatively coupled to relay coil 70. Contact 78 of contact set 74 is connected to switch terminal 72 and the common contact 80 of contact set 74 is connected to the common contact 82 of contact set 76. A normally closed, two position stop switch 86 is connected between terminals 80, 82 and contact 88 of start switch 68. Contact 90 contact set 76 is connected to one wiper 92 of a ganged multiple position, manually operated switch 94.

A conventional direct current power supply 96 is provided having its positive output terminal 98 connected to output terminal 100 of connector 50. The common terminal 102 of power supply 96 is connected to the wiper 104 of multiple position switch 94 and to output terminal 106 of connector 50. Counter 12 is also connected to the source of alternating current operating potential (not shown) through switch 66 and a conductor 110.

Figure 2:
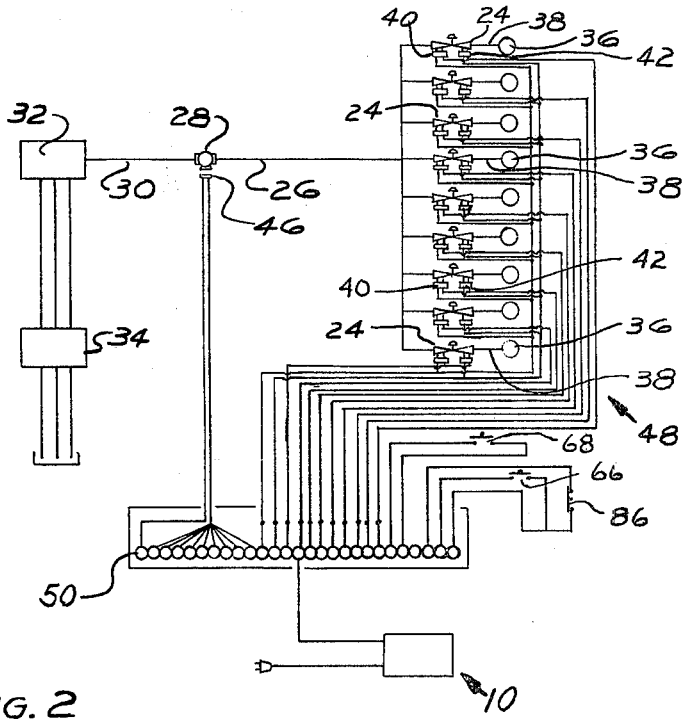
FIG. 2 is a block diagram showing the controller of the present invention adapted to a multiple dispenser, single product application.

Individual ones of the slow-flow solenoids 42 are connected electrically to ground 73 through individual ones of the contacts 114 of multiple position switch 94 and contacts 22 associated with control relay 18. Similarly, the fast-flow solenoids 40 are connected electrically to ground 73 through individual ones of the contacts 114 and contacts 20 associated with control relay 16. In the embodiment of FIG. 3, corresponding ones of the motor controllers 34 associated with individual ones of the flow control valves 24 are connected electrically in shunt with the corresponding slow-flow solenoids 42. In the embodiment of FIG. 2, only a single motor controller 34 is incorporated and this has one contact thereof connected in common to all of the contacts 114 of switch 94 by means of a suitable jumper wire (not shown).

Individual ones of the pulsers 46 are connected electrically in series between individual ones of the contacts 116 of ganged switch 94 and the pulse input terminal 56 of counter 12. A reset button 120, normally open, is connected between the direct current supply terminal 102 and the reset input terminal 122 of counter 12.

In operation, on-off switch 66 is closed applying alternating current potential to terminal 88 of start-stop switch 68. The circuit does not further respond until momentary start-stop switch 68 is closed. This applies alternating current potential to relay coil 70. Relay coil 70 operates to effect closure of contact sets 74, 76. Closure of contact set 74 provides a path for alternating potential via stop switch 86 to relay coil 70 thereby latching the coil. Simultaneously, alternating current potential passes through contact set 76 to the wiper 92 of switch 94. Depending upon the position of wiper 92, alternating current potential is supplied to one of the motor controllers 34, slow-flow solenoids 42, and fast-flow solenoids 40. When the motor controller 34 is activated, the pump 32 associated therewith, (just one pump 32 in the embodiment of FIG. 2) is energized and material begins to pass through meter 28. As the material flows therethrough, incremental quantity pulses are generated by the pulser 46 associated therewith and these pulses are applied to the pulse input terminal 56 of counter 12. The incremental pulse signals are added or otherwise accumulated within the counter 12. When the quantity of material that has been dispensed, pumped, or the like equals the quantity initially entered on switches 52 less the quantity entered on switches 54, the fast-flow signal appearing at output terminal 58 of counter 12 terminates. This deactivates relay 16 causing contacts 20 associated therewith to open. This in turn deactivates the fast-flow solenoid 40 and flow through the flow control valve 24 drops to the slow-flow rate. When the quantity of material dispensed equals the total quantity of material entered via switches 52, the slow-flow signal appearing at output terminal 60 of counter 12 terminates deactivating relay coil 18 causing contacts 22 associated therewith to open. This in turn deactivates the slow-flow solenoid 42 and motor controller 34 connected thereto. This terminates dispensing. Termination of the dispensing cycle is highly accurate inasmuch as the flow through the flow control valve 24 during the last portion of the dispensing cycle is substantially reduced. Switch 94 is now manually operated to connect a different fast-flow solenoid, slow-flow solenoid and motor controller (in the embodiment of FIG. 3) to the controller circuit 10. Manual operation of the reset button 120 resets counter 12 and the cycle repeats as described above. In the event of a power failure or other interruption of power to the system, the latching circuit including relay contacts 74 are automatically deactivated and dispensing of material ceases and must be manually restarted. Similarly, in the event of failure of relays 16, 18, or 70, dispensing will terminate automatically. This provides fail-safe operation of the controller such that flow of material, which in many cases may be a hazardous or otherwise dangerous material, is automatically terminated. It will also be observed that alternating current potential is continuously applied to counter 12 except in the event of an absolute power failure. Counter 12 is correspondingly preferably provided with a memory or holding capability whereby operation of the system can be halted by operating stop switch 86 without losing the registered quantity of fluid or material dispensed to that point.

Figure 4:
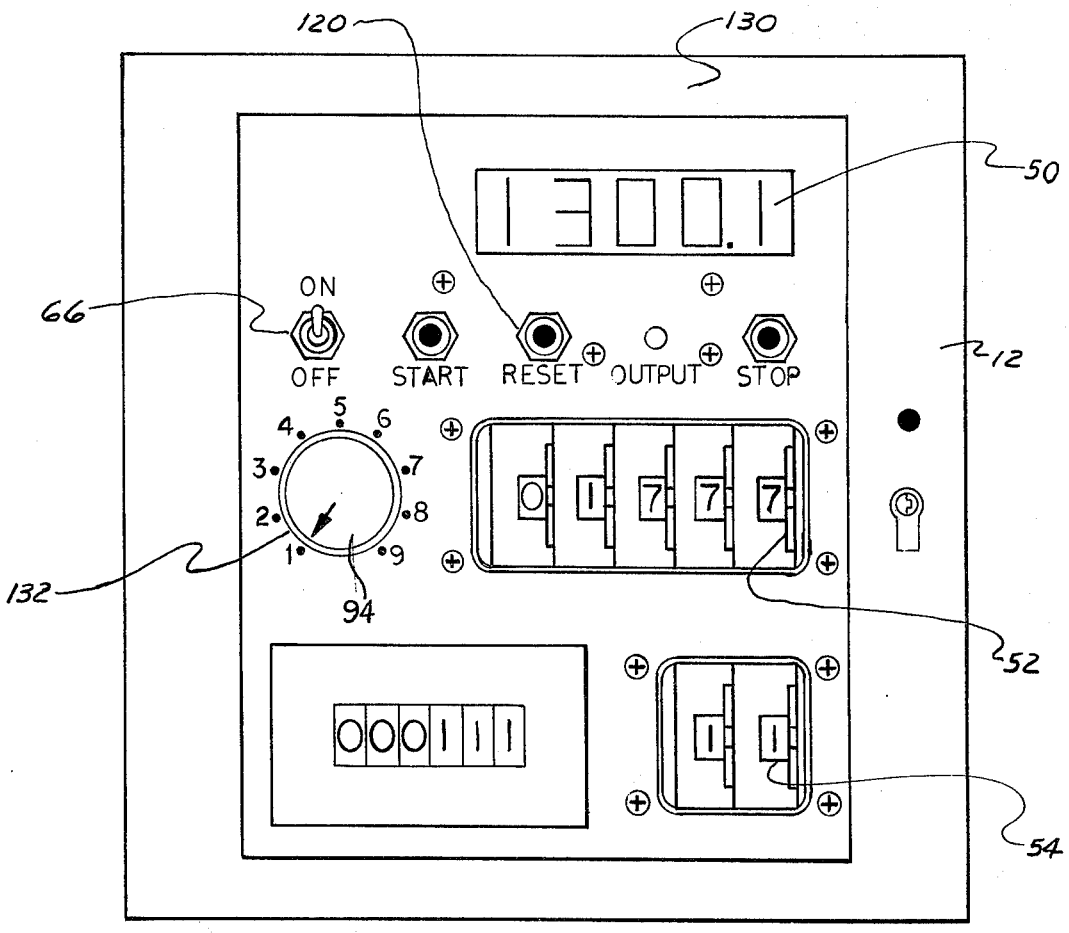
FIG. 4 is a plan view of a controller in accordance with the present invention showing the quantity input switches and digital indicating means.

The entire circuit can be enclosed in the relatively small housing 130 as seen in FIG. 4 with the operating knob 132 for switch 94 being provided on the face along with a reset switch 120, the on-off switch 66, as well as the aforementioned digital readout 50, and input switches 52, 54. The batch controller 10 can be easily adapted for multiple material batch dispensing as illustrated in FIG. 2 by simply connecting the motor controller 34 and pulser 46 to all of the contacts 114 and 116 of switch 94. Alternatively, the batch controller 10 can be adapted for single material batch dispensing wherein it is used to control a plurality of different dispensers using a common supply tank as illustrated in FIG. 3. The system is relatively inexpensive, comprises substantially all solid state components. Even the relays 16, 18, and 70, can be provided in the form of solid state control elements if desired. This controller is versatile in that it can be applied to a wide variety of batching applications. The fast-flow and slow-flow solenoids and associated flow control valves can be replaced with appropriate dampers, gates or other flow metering devices or to conveyors or other dispensing units operable at both the fast and slow-flow rates whereby the system can be used to provide batch mixing or multiple dispenser metering of numerous materials.

While there have been described above the principles of this invention in connection with specific apparatus, it is to be clearly understood that this description is made only by way of example and not as a limitation to the scope of the invention.

What is claimed is:

1. In a batch controller for controlling a plurality of material dispensers, the combination comprising starting circuit means connected to a source of operating potential and including a switch for generating an operating signal in response to operation of said switch, reset circuit means including a reset switch for generating a reset signal in response to operation of said reset switch, presettable counter means for generating a fast-flow control signal and a slow-flow control signal in response to said operating signal, said presettable counter means including a pulse input circuit for receiving electrical pulse signals, means for terminating said fast-flow signal in response to a first selected number of said pulse signals and means for terminating said slow-flow signal in response to a second selected number of said pulse signals, a plurality of flow generating means operable between on and off states in response to said operating signal and said slow-flow signal for generating a flow of material, a pulse generating means coupled to the output of each of said flow generating means for generating an electrical pulse signal in response to each incremental quantity of flow therefrom, a plurality of fast-flow control valve means each being operable between open and closed conditions in response to said operating signal and said fast-flow control signal and to the absence thereof, respectively, for controlling the flow of said material at a first flow rate, a plurality of slow-flow control valve means each being operable between open and closed conditions in response to said operating signal and said slow-flow control signal and to the absence thereof, respectively, for controlling the flow of said material at a second flow rate, said second flow rate being substantially smaller than said first flow rate, there being one said fast-flow control valve means, one of said slow-flow control valve means and one of said incremental pulse generating means associated with each said flow generating means, respectively, and multiple position switch means for individually coupling associated ones of said flow generating means, fast-flow control valve means, slow-flow control valve means, and electrical pulse generating means to said presettable counter means.

2. The combination of claim 1 wherein said fast and slow-flow control valves are electrically operated, and further including first and second normally open switch means connected electrically in series with said fast and slow-flow control valves and said source of operating potential, said first and second switch means being rendered conductive in response to said fast-flow control and slow-flow control signals, respectively, said first and second switch means being nonconductive in the absence of said operating signal and the absence of said fast-flow control and slow-flow control signals, respectively.

3. The combination of claim 2 wherein said materials are fluids, said flow control valves being fluid flow control valves, said electrical pulse generating means being a pulser calibrated to generate one said electrical pulse for each incremental quantity of fluid dispensed.

4. The combination of claim 3 wherein said fluids include a plurality of different fluids, there being one of said associated groups of flow generating means, said pulsers, said fast-flow control valves, and said slow-flow control valves associated with each said fluid, whereby manipulation of said multiple position switch means to different positions thereof and selection of different numbers of said incremental pulses effects sequential and automatic measurement of different quantities of different fluids to thereby meter mixed batches thereof.

5. The combination of claim 3 wherein said starting circuit switch is a momentary contact switch, said starting circuit means further including a latching circuit having an input terminal connected to said source of operating potential and an output terminal, said latching circuit being rendered latched in response to momentary operation of said starting switch, said operating signal appearing at said output terminal when said latching circuit is latched, said latching circuit becoming unlatched in response to the absence of said operating signal, said presettable counter means, said fast-flow control valves, said slow-flow control valve, and said flow generating means being connected to said output terminal, whereby, absence of said operating signal renders same inoperative.

* * * * *